US008572850B2

(12) United States Patent
Wu

(10) Patent No.: US 8,572,850 B2
(45) Date of Patent: Nov. 5, 2013

(54) CARPET KNIFE

(76) Inventor: Yuewei Wu, Ninghai (CN)

( * ) Notice: Subject to any disclaimer, the term of this patent is extended or adjusted under 35 U.S.C. 154(b) by 404 days.

(21) Appl. No.: 12/819,178

(22) Filed: Jun. 19, 2010

(65) Prior Publication Data

US 2011/0308094 A1 Dec. 22, 2011

(51) Int. Cl.
*B26B 5/00* (2006.01)

(52) U.S. Cl.
USPC ..... 30/125; 30/333; 30/339

(58) Field of Classification Search
USPC ..... 30/125, 329, 332, 333, 337, 339, 330, 30/331
See application file for complete search history.

(56) References Cited

U.S. PATENT DOCUMENTS

| | | | | | |
|---|---|---|---|---|---|
| 3,509,627 | A * | 5/1970 | Gilbert et al. | 30/125 |
| D235,414 | S * | 6/1975 | Miller | D8/98 |
| 4,261,104 | A * | 4/1981 | Cuscovitch | 30/330 |
| 5,404,645 | A * | 4/1995 | Janser | 30/125 |
| 5,940,970 | A * | 8/1999 | D'Ambro et al. | 30/125 |
| 6,026,575 | A * | 2/2000 | Wonderley | 30/125 |
| 6,233,830 | B1 * | 5/2001 | Lamond et al. | 30/123 |
| 6,574,872 | B2 * | 6/2003 | Roberts et al. | 30/330 |
| 6,742,260 | B1 * | 6/2004 | Hsu | 30/162 |
| 6,845,561 | B2 * | 1/2005 | Timson | 30/125 |
| 6,865,816 | B1 * | 3/2005 | Zajdel | 30/330 |
| 6,971,178 | B2 * | 12/2005 | Rowlay | 30/162 |
| D592,032 | S * | 5/2009 | Wu | D8/98 |
| 7,941,927 | B1 * | 5/2011 | Demko | 30/161 |
| D645,721 | S * | 9/2011 | Wu | D8/99 |
| 2010/0180450 | A1 * | 7/2010 | Van Deursen | 30/162 |
| 2011/0308094 | A1 * | 12/2011 | Wu | 30/333 |
| 2012/0011728 | A1 * | 1/2012 | Keers | 30/164 |

* cited by examiner

*Primary Examiner* — Hwei C Payer

(57) ABSTRACT

A carpet knife having a housing, an active blade installed in the housing, and a blade clamping means having a clamping cover and a thumb screw. The housing has a thumb screw hole, a pin hole, at least one side guiding groove, and an active blade installation bar. The clamping cover has at least one side guiding bar having a wedge outer surface, and a rear eccentric guiding groove. The thumb screw has a head having an under surface and a shank formed on the under surface. The head has a pin formed on the under surface thereof which is able to enter and move in the rear eccentric guiding groove.

16 Claims, 3 Drawing Sheets

Prior Art

CARPET KNIFE

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention relates to a carpet knife, and more particularly, to the carpet knife an active blade thereof is able to be stably fixed and simply exchanged.

2. Description of Related Art

Carpet knife is a kind of utility knife, which is a commonly used hand tool for cutting, e.g., wood, paper, leather, plastic panel, cord, cardboard, and particularly, carpet or rug. Shown in FIG. 5*a* is a conventional carpet knife 9. The carpet knife 9 usually has a housing made up of a right cover 91 and a left cover 92 detachably coupling together. FIG. 5*b* is a perspective view showing an inner side of the right cover 91. The right and the left cover 91 and 92 are fixed together to form the housing by a thumb screw 93. There is a blade chamber 94 defined in a front portion of the housing for containing an active blade 95. An active blade installation bar 96 is formed in the blade chamber 94. The active blade 95 is able to be installed in the blade chamber 94 with a central slot 951 thereof covering the active blade installation bar 96. When a user rotates to tighten the thumb screw 93, the right and the left cover 91 and 92 move closer with respect to each other and the active blade 95 will be able to be pressed and thus clamped by a touching surface 941 of the blade chamber 94. A spare blade installation bar 97 may be formed in the housing for placement of spare blades. The housing acts as both a handle and a container for active and spare blades.

Such kind of carpet knife has some drawbacks. First, the active blade 95 is not easily able to be stably fixed. If the user tighten the thumb screw 93 insufficiently, a tiny distance between touching surfaces 941 of the right cover 91 and the left cover 92 may cause cross movement of the active blade 95. However, if the user tighten the thumb screw 93 overly, the front portions of the right and the left cover 91 and 92 may warp and move apart, which also makes the active blade 95 unstable. Second, either in tightening or in releasing, a user usually has to rotate the thumb screw 93 a number of rounds. Together with finding and aligning a thumb screw hole, replacement of dull blade for such carpet knife takes longer time. Third, after repeatedly use, the thumb screw 93 is liable to loose, usually slightly, which may cause unstable of the active blade 95.

BRIEF SUMMARY OF THE INVENTION

The main object of the invention is to provide a carpet knife an active blade thereof is able to be stably fixed.

Another object of the invention is to provide a carpet knife a dull blade thereof is able to be simply exchanged in a shorter time.

In accordance with one aspect of the invention, there is provided a carpet knife having a housing made up of a first cover and a second cover detachably coupling together, an active blade installed in the housing, and a blade clamping means having a clamping cover and a thumb screw. The housing has a thumb screw hole, a pin hole, at least one side guiding groove, and an active blade installation bar. The clamping cover has an inner surface contacting the active blade, an outer surface, at least one side guiding bar having a wedge outer surface, and a rear eccentric guiding groove. The thumb screw has a head having an under surface and a shank formed on the under surface. The shank has a snap ring groove defined therein which is able to receive a locating snap ring for positioning the thumb screw with respect to the housing and the head has a pin formed on the under surface thereof.

These and other objectives, features, and advantages of the present invention will become apparent from the following detailed description, the accompanying drawings, and the appended claims.

DETAILED DESCRIPTION OF THE INVENTION

Figure 1:
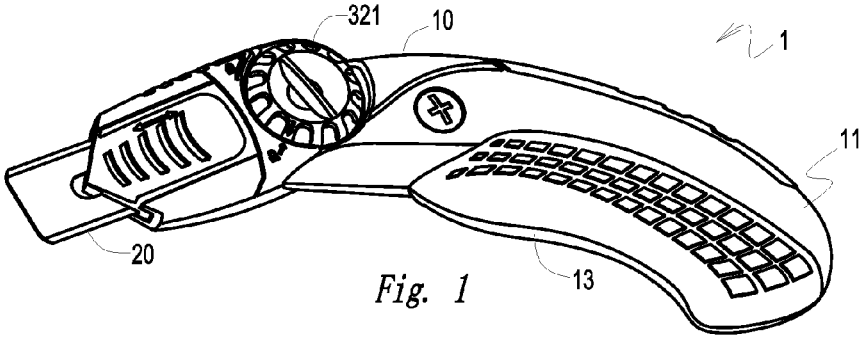
FIG. 1 is a perspective schematic view of the preferred embodiment of the carpet knife of the invention.
Figures 3, 4D:
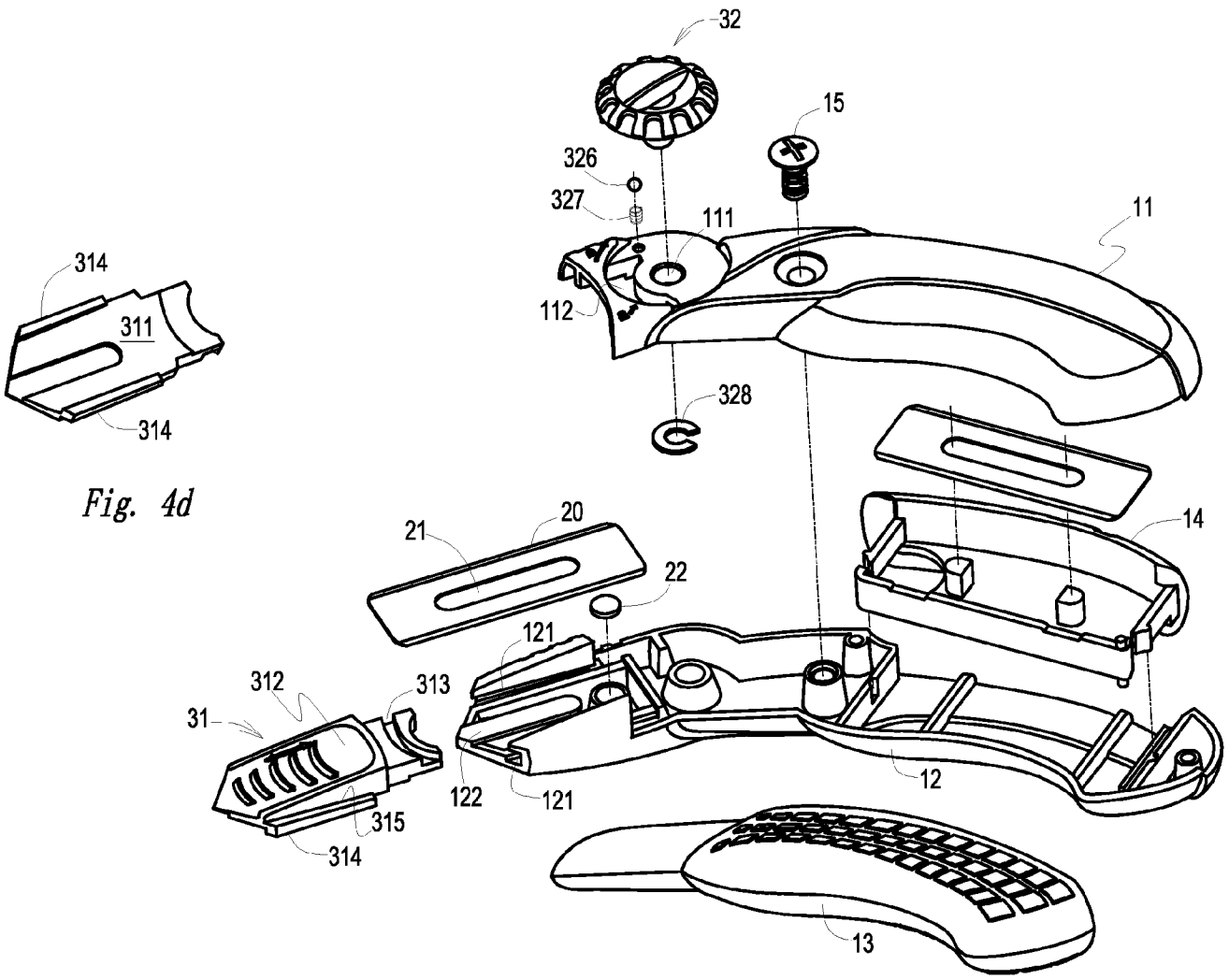
FIG. 3 is another exploded perspective view showing the carpet knife shown in FIG. 1.
FIG. 4*d* is a schematic perspective view showing an inner surface of the clamping cover shown in FIGS. 1 and 2.

With reference to FIGS. 1 and 3, a carpet knife 1 of the preferred embodiment of the invention is shown. The carpet knife 1 has a housing 10 made up of a first cover 11 and a second cover 12 detachably coupling together. In this embodiment, the first and the second covers 11 and 12 are fixed together by a screw 15. The housing 10 has a rear portion for grasping of a user and a front portion for installation of an active blade 20. The carpet knife 1 further has a blade clamping means 30 which has a clamping cover 31 and a thumb screw 32.

Figure 2:
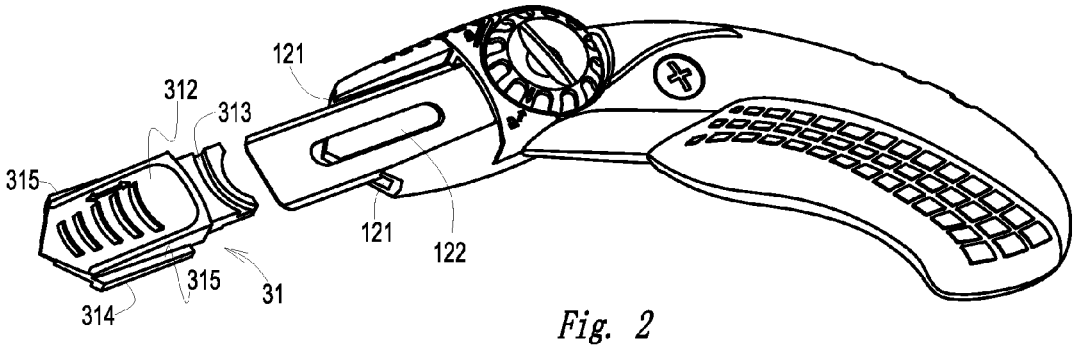
FIG. 2 is an exploded perspective view showing the carpet knife shown in FIG. 1 with a clamping cover thereof being moved off.

With reference to FIGS. 2 and 4*d*, the clamping cover 31 has an inner surface 311 which contacts the active blade 20 and an outer surface 312 defining part of contour of the housing 10. The clamping cover 31 further has a rear eccentric guiding groove 313 and at least one side guiding bar 314 which is able to be slidably contained in a corresponding side guiding groove 121 defined in the housing 10. The side guiding bar 314 has a wedge outer surface 315 which tapers from a front to the rear end of the clamping cover 31.

Figure 4A:
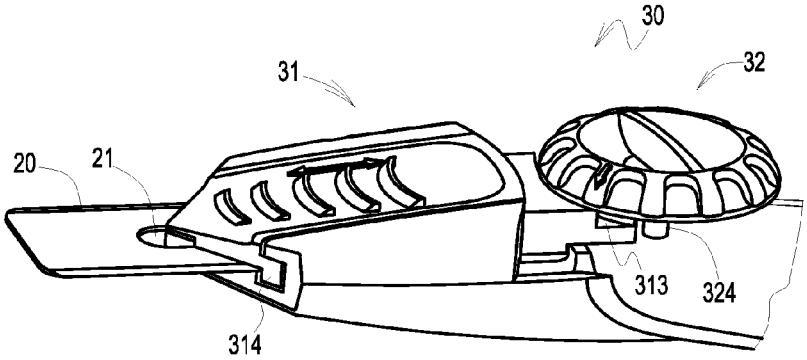
FIG. 4*a* a partially enlarged schematic perspective view showing the carpet knife shown in FIG. 1.
Figure 4B:
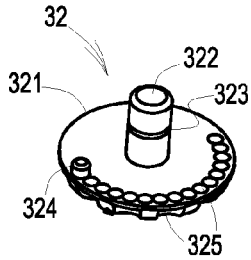
FIG. 4*b* is an enlarged schematic perspective view showing a thumb screw of the carpet knife shown in FIG. 1.

As particularly shown in FIG. 4*b*, the thumb screw 32 has a head 321 having an under surface on which a shank 322 is formed. A snap ring groove 323 is defined in the shank 322 and a pin 324 is formed on a peripheral of the head 321 on the under surface thereof. A plurality of shallow dents 325 are defined in the under surface along the peripheral of the head 321.

Figure 4C:
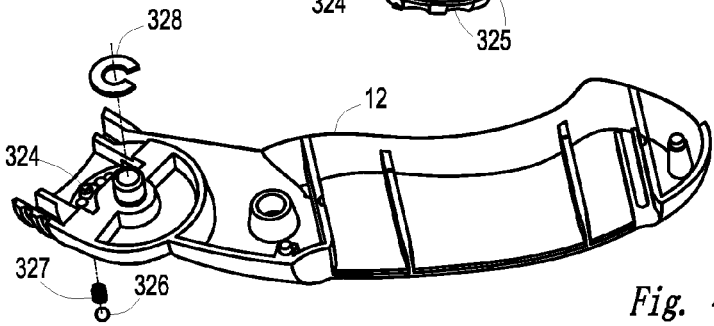
FIG. 4*c* is another partial schematic view showing the carpet knife shown in FIG. 1.
Figure 5A:
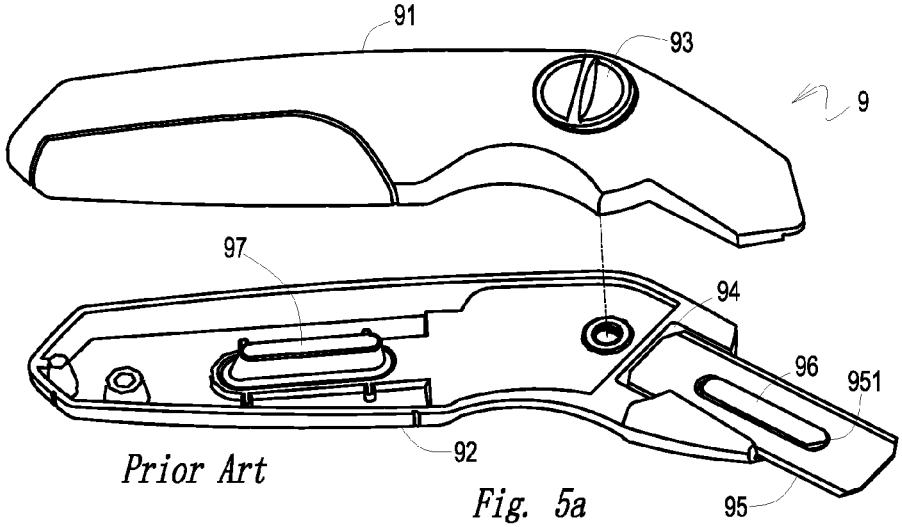
Fig. 5a Prior Art
FIG. 5*a* is a schematic exploded perspective views showing a conventional carpet knife. And, FIG. 5*b* is a schematic perspective view of a right cover of the carpet knife shown in FIG. 5*a*.
Figure 5B:
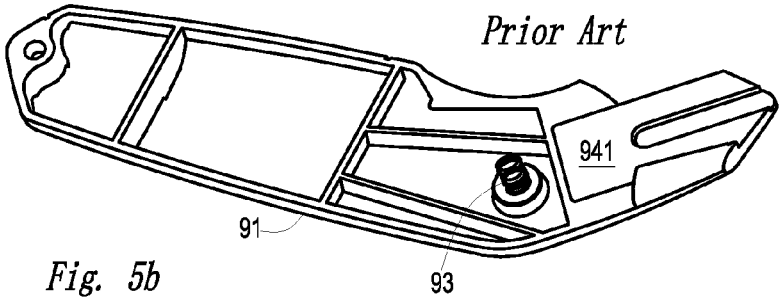

As shown in FIGS. 3 and 4*c*, a thumb screw hole 111 is defined in the housing 10 through which the shank 322 of the thumb screw 32 passes. A locating snap ring 328 is able to put into the snap ring groove 323 round the shank 322 after the shank 322 is inserted through the thumb screw hole 111, making the thumb screw 32 only be able to rotate with respect to the housing 10. A pin hole 112 is defined in the housing 10 through which the pin 324 is able to pass when the shank 322 in inserted through the thumb screw hole 111. An active blade installation bar 122 is formed on an inner surface of the housing 10 which is able to pass through a central slot 21 defined in the active blade 20.

In use, a user is able to place the active blade 20 in the housing 10 with the central slot 21 covering on the active blade installation bar 122, as shown in FIG. 2, and then insert the side guiding bar 314 of the clamping cover 31 into the corresponding side guiding groove 121 and push the clamping cover 31 rearward to the housing 10. As the partially exploded enlarged view shown in FIG. 4*a*, when the clamping cover 31 is pushed to a nearly further most position, the wedge outer surface 315 of the side guiding bar 314 meets an inner surface of the side guiding groove 121 and the pin 324 of the thumb screw 32 is in align with the rear eccentric guiding groove 313. At this time, when the user rotates the thumb screw 32, the pin 324 will enter and then move along the rear eccentric guiding groove 313. When moves along the rear eccentric guiding groove 313, the pin 324 is able to further drive the clamping cover 31 rearward by pushing an inner wall of the rear eccentric guiding groove 313, though slightly. In this further movement of the clamping cover 31, as the wedge outer surface 315 of the side guiding bar 314 moves along the side guiding groove 121, the clamping cover 31 is pushed by the inner surface of the side guiding groove 121 to move slightly in a cross direction from the outer surface 312 thereof to the inner surface 311 thereof. This slightly cross movement of the clamping cover 31 is able to make the active blade 20 be tightly clamped between the clamping cover 31 and the housing 10. A reverse operation will be able to release the clamping cover 31 and replace a dull blade.

It could be seen from above description, that with the wedge outer surface 315 which is firmly pressed by the inner surface of the side guiding groove 121, the active blade 20 is able to be very stably clamped between the clamping cover 31 and the housing 10 and will not move cross-sectionally in use. Furthermore, only a rotation of the thumb screw 32 of a relatively small angle, which is about 90 degree, instead of several rounds, will be sufficient to exchange a dull blade 20. It is much simpler and time saving.

As shown in FIG. 3, a steel ball 326 urged by a spring 327 may be provided between the housing 10 and the under surface of the head 321 of the thumb screw 32. A part of the steel ball 326 is able to be continuously received in one of the plurality of shallow dents 325 when the thumb screw 32 rotates, thus positioning the thumb screw 32 with a slight amount of force. This slight positioning force will be able to keep the thumb screw 32 from loosing after repeatedly use of the carpet knife 1. A spare blade container 14 may be provided detachably contained in the housing 10 of the carpet knife 1. Still with reference to FIG. 3, a magnet 22 may be securely installed in the housing 10 on a surface facing the active blade 20. The magnet 22 is able to make the active blade 20, which is ferrous, stabler with respect to the housing 10. A rubber housing cover 13 also may be provided to improve feeling of grasping of the utility knife 1.

From above description, it is seen that the objects of the present invention have been fully and effectively accomplished. Embodiment of the invention has been shown and described for the purposes of illustrating the functional and structural principles of the present invention and is subject to change without departure from the invention's principles. Therefore, this invention includes all modifications encompassed within the spirit and scope of the following claims.

The invention claimed is:

1. A carpet knife comprising:

a housing made up of a first cover and a second cover detachably coupling together, said housing having a thumb screw hole, a pin hole, at least one side guiding groove, and an active blade installation bar;

an active blade installed in said housing; and, a blade clamping means having a clamping cover and a thumb screw, said clamping cover having an inner surface contacting said active blade, an outer surface, at least one side guiding bar having a wedge outer surface, and a rear eccentric guiding groove, said thumb screw having a head having an under surface, a shank formed on said under surface and having a snap ring groove defined therein, a locating snap ring received in said snap ring groove, and a pin formed on said under surface thereof.

2. The carpet knife as claimed in claim 1, wherein between said housing and said under surface of said head there is provided a steel ball which is urged by a spring, and said head further has a plurality of shallow dents in said under surface along a peripheral thereof each of which is able to receive a part of said steel ball.

3. The carpet knife as claimed in claim 1, wherein said housing further has a rubber housing cover.

4. The carpet knife as claimed in claim 2, wherein said housing further has a rubber housing cover.

5. The carpet knife as claimed in claim 1, wherein said housing further has a spare blade container detachably contained therein.

6. The carpet knife as claimed in claim 2, wherein said housing further has a spare blade container detachably contained therein.

7. The carpet knife as claimed in claim 3, wherein said housing further has a spare blade container detachably contained therein.

8. The carpet knife as claimed in claim 4, wherein said housing further has a spare blade container detachably contained therein.

9. The carpet knife as claimed in claim 1, wherein a magnet is securely installed in said housing on a surface facing said active blade.

10. The carpet knife as claimed in claim 2, wherein a magnet is securely installed in said housing on a surface facing said active blade.

11. The carpet knife as claimed in claim 3, wherein a magnet is securely installed in said housing on a surface facing said active blade.

12. The carpet knife as claimed in claim 4, wherein a magnet is securely installed in said housing on a surface facing said active blade.

13. The carpet knife as claimed in claim 5, wherein a magnet is securely installed in said housing on a surface facing said active blade.

14. The carpet knife as claimed in claim 6, wherein a magnet is securely installed in said housing on a surface facing said active blade.

15. The carpet knife as claimed in claim 7, wherein a magnet is securely installed in said housing on a surface facing said active blade.

16. The carpet knife as claimed in claim 8, wherein a magnet is securely installed in said housing on a surface facing said active blade.

* * * * *